US005500986A

United States Patent [19]

Leifeld et al.

[11] Patent Number: 5,500,986

[45] Date of Patent: Mar. 26, 1996

[54] METHOD AND APPARATUS FOR MOVING RECTANGULAR COILER CANS

[75] Inventors: Ferdinand Leifeld, Kempen; Stefan Schlichter, Viersen; Bernhard Windges, Mönchengladbach; Siegfried Günkinger, Heiningen, all of Germany

[73] Assignee: Trützscher GmbH & Co. KG, Mönchengladbach, Germany

[21] Appl. No.: 242,639

[22] Filed: May 13, 1994

[30] Foreign Application Priority Data

May 14, 1993 [DE] Germany ..... 43 16 158.8
Mar. 4, 1994 [DE] Germany ..... 44 07 110.8

[51] Int. Cl.[6] ..... D01H 9/18

[52] U.S. Cl. ..... 19/159 A; 57/281

[58] Field of Search ..... 19/159 A; 57/400, 57/263, 281

[56] References Cited

U.S. PATENT DOCUMENTS

| | | | |
|---|---|---|---|
| 3,323,177 | 6/1967 | Binder et al. | 19/159 A |
| 3,443,287 | 5/1969 | Hertzsch | 19/159 A |
| 4,012,893 | 3/1977 | Weber | 19/159 A X |
| 4,469,214 | 9/1984 | Maurer et al. | 198/339 |
| 5,138,558 | 8/1992 | Meyer et al. | 19/159 A X |

FOREIGN PATENT DOCUMENTS

| | | | |
|---|---|---|---|
| 0344484 | 12/1989 | European Pat. Off. . | |
| 0384360 | 8/1990 | European Pat. Off. . | |
| 0457099 | 11/1991 | European Pat. Off. . | |
| 0493344 | 7/1992 | European Pat. Off. . | |
| 0531754 | 3/1993 | European Pat. Off. . | |
| 2357428 | 5/1975 | Germany . | |
| 4231698 | 3/1993 | Germany . | |
| 2028416 | 2/1987 | Japan | 19/159 A |
| 0168154 | 3/1965 | U.S.S.R. | 19/159 A |
| 0334413 | 9/1930 | United Kingdom | 19/159 A |
| 1126926 | 9/1968 | United Kingdom . | |
| 1295316 | 11/1972 | United Kingdom . | |
| 1436857 | 5/1976 | United Kingdom . | |
| 2104924 | 3/1983 | United Kingdom . | |
| 2245284 | 1/1992 | United Kingdom . | |
| 91/18135 | 11/1991 | WIPO . | |

*Primary Examiner*—Andy Falik
*Assistant Examiner*—Ismael Izaguirre
*Attorney, Agent, or Firm*—Spencer & Frank

[57] ABSTRACT

A method of handling flat coiler cans charged and to be charged with sliver in a sliver charging station of a sliver producing fiber processing machine includes the following steps: advancing an empty can into a first standby station situated in a zone of the sliver charging station; advancing an empty can from the first standby station into the sliver charging station; charging a can with sliver in the sliver charging station; advancing a full can from the sliver charging station into a second standby station situated in a zone of the sliver charging station; and advancing a full can out of the second standby station.

22 Claims, 4 Drawing Sheets

METHOD AND APPARATUS FOR MOVING RECTANGULAR COILER CANS

CROSS REFERENCE TO RELATED APPLICATION

This application claims the priority of German Application Nos. P 43 16 158.8 filed May 14, 1993 and P 44 07 110.8 filed Mar. 4, 1994, which are incorporated herein by reference.

BACKGROUND OF THE INVENTION

This invention relates to a method and an apparatus for moving coiler cans having an elongated (flat) horizontal cross section, to and from a sliver charging station of a fiber processing machine, such as a drawing frame or a carding machine. The sliver, composed of cotton or synthetic fibers or the like is discharged by a rotary coiler disc (coiler head) and deposited in coils. The can is, during the sliver charging (depositing) process, moved back-and-forth. An empty can is introduced into the charging station, for example, from an empty-can storage device, the can is charged with sliver in the charging station and the filled can is removed from the charging station, for example, to a full-can storage device.

In a known process of the above-outlined type, as disclosed, for example, in Published International Application WO 91/18135, an empty-can storage device and a full-can storage device are arranged in series. Between the two storage devices an intermediate space for one can is provided which is coupled perpendicularly to the zone of the charging head of the drafting frame by a can displacing device formed of chains and rollers. In operation, an empty can is moved from the empty-can storage device into the intermediate space and then, by means of the can displacing device, to the zone of the charging head where it is filled with sliver and thereafter it is displaced in the opposite direction on the same can displacing device back into the intermediate space and therefrom into the full-can storage device.

Such a conventional process is time-consuming as concerns the steps of can transport and can exchange. The empty and full cans have to travel from the intermediate space to the charging station, and during such a can transport the filling operation in the charging station has to be interrupted. During the return conveyance of an empty can, the can displacing device for the return conveyance of a full can is blocked; likewise, blockage occurs for an empty can during the return of a full can. In addition, after filling the can in the charging station, the can replacement in the intermediate space occurs with a delay because of the above-noted can conveyance. Before an empty can arrives at the sliver charging station, the can replacement in the intermediate space and the transporting to the charging station have to be completed. Can exchange and transport thus proceed consecutively and therefore waiting periods occur in the charging station. In current high-performance drafting frames having sliver delivery speeds of 1,000 m/min and above, such a high output speed capacity of the drafting frame is significantly underutilized because of the abovenoted necessary waiting periods. It is a further disadvantage of the prior art arrangements that they are structurally complex and expensive since the performance of the described process needs particular structural measures. For example, the drafting frame has to be stopped until an empty can is properly positioned in the charging station. Also, the can replacement device and the intermediate space may be utilized only for a single can at any one time.

SUMMARY OF THE INVENTION

It is an object of the invention to provide an improved method and apparatus of the above-outlined type with which the discussed disadvantages are eliminated and which, in particular, makes possible to operate a drafting frame or carding machine at its high output capacity and makes possible a displacement of sliver cans with high speed into and out of the charging station.

This object and others to become apparent as the specification progresses, are accomplished by the invention, according to which, briefly stated, the method of handling flat coiler cans charged and to be charged with sliver in a sliver charging station of a sliver producing fiber processing machine includes the following steps: advancing an empty can into a first standby station situated in a zone of the sliver charging station; advancing an empty can from the first standby station into the sliver charging station; charging a can with sliver in the sliver charging station; advancing a full can from the sliver charging station into a second standby station situated in a zone of the sliver charging station; and advancing a full can out of the second standby station.

The method according to the invention is practiced with two standby stations provided in the zone of the charging station. In this manner, a very short can exchange period is achieved in the charging station. The empty can situated in the standby station may be directly and along a short path moved into the charging station and likewise, the full can may be, along a short path, taken from the charging station and placed into an empty emplacement of the full-can standby station. During the displacement of the cans into or out of the respective standby stations sliver may be continued to be deposited into a further can in the charging station, so that idle periods are avoided. The two standby stations in the zone of the charging station thus permit a time-saving readying of the empty cans at the charging station and furthermore ensure a rapid exchange in the charging station proper so that a high working speed is achieved which encompasses the can replacement and the charging of the can with sliver.

At the same time, by virtue of the method according to the invention, a high output rate of the drafting frame is possible and similarly, the invention may be effectively used with high-production carding machines which have an output delivery speed of 300 m/min and above. In current drafting frames having sliver output velocities of 1000 m/min and above the rapid charging of the sliver according to the process of the invention is combined with the rapid can replacement so that a higher degree of efficiency of the drafting frame or carding machine is achieved. The high running speed of the sliver permits a rapid filling of the can; such a high output speed results largely because of the short and rapid can exchange process which, in turn, is made possible by the provision of two standby stations that are ready immediately for the can-exchange operation and by the fact that the standby stations may be provided with cans actively or passively while the sliver charging operation is in process.

According to a preferred embodiment of the invention, the empty cans and the full cans are simultaneously displaced from the first standby station into the charging station and, respectively, from the charging station into the second standby station. Particularly short can replacement periods may be achieved if, according to a further preferred embodiment of the invention, the can replacement is carried out in the direction parallel to the short can walls in which case the empty and full cans are situated side-by-side. There is thus performed a transverse shift-of the cans where the path to be travelled essentially corresponds to the can width and there need only be provided such a clearance between the cans which permit movements of the cans relative to one another. According to a further preferred embodiment of the invention, the empty cans are conveyed from an upstream storing device, carriage or the like into the first standby station and, according to a further embodiment, the full cans are conveyed from the second standby station into an after-connected (downstream) storage carriage or the like.

Advantageously, according to the invention an empty can and a full can are simultaneously moved into the first and, respectively, out of the second standby station, while during the sliver charging of one can the empty can and/or the full can is moved into the first or, respectively, out of the second standby station. The simultaneous displacement of the empty and full cans make possible a simple circuitry when separate drives are present for the conveying mechanisms for the empty and the full cans. It is even possible to operate with a sole endless conveying system, such as a circular (carousel) conveyor which operates intermittently. During the conveying pauses the can exchange may take place, whereas the charging process occurs simultaneously with the motion of the conveyor.

Expediently, the empty cans are moved into the first standby station and the full cans are moved from the second standby station parallel to the charging station as viewed in the longitudinal dimension of the flat can. Advantageously, the displacement of the empty can into the first standby station and the removal of the full can from the second standby station is effected from the same side. The empty can is, from the empty-can storage device moved into a position which is ahead of the first standby station. Likewise, the full can is displaced from the second standby station into a position which is ahead of the full-can storage device. In the second standby station a can emplacement is provided which is empty at the beginning of the can-replacing operation and thus the full can is displaced from the charging station into the empty can emplacement. During can exchange the cans are moved in a transverse direction for a back-and-forth movement of the cans in the charging station. The first and the second standby stations each have at least one can emplacement. The longitudinal axes of the cans are in alignment in the first and second standby stations and in the charging station. During can exchange the long walls of the cans are oriented parallel to one another.

Advantageously, the direction of the back-and-forth motion of the cans during the sliver charging process and the direction of can replacement into and out of the charging station are perpendicular to one another. By means of such an arrangement it is feasible to simultaneously fill the cans and displace them for supply and removal. At the height of the charging station the empty can is directly displaced from the first standby station into the charging station and the full can is directly displaced from the charging station into the second standby station.

For performing the above-outlined method, the invention further provides an apparatus for handling flat coiler cans in the zone of a sliver charging station. The apparatus is provided at a sliver producing fiber processing machine, particularly a drafting frame or a carding machine which delivers the sliver from a rotary coiler head and deposits the sliver in coils in the coiler cans. The coiler can undergoing sliver deposition is displaced back-and-forth under the coiler head. The apparatus includes a first standby station situated adjacent the sliver charging station of the fiber processing machine for receiving an empty can; a second standby station situated adjacent the sliver charging station for receiving a full can from the sliver charging station; and a can shifting device for displacing an empty can from the first standby station into the sliver charging station and for displacing a full can from the sliver charging station into the second standby station.

According to an advantageous embodiment of the apparatus, the first standby station and the second standby station are arranged parallel to the charging station. The can in the charging station executes a back-and-forth motion whose amplitude essentially corresponds to twice the horizontal length dimension of the can. Preferably, the can emplacement for the empty cans in the first standby station, the can emplacement for the full cans in the charging station and the empty can emplacement in the second standby station are positioned parallel to one another during the can replacement. Preferably, on both sides of the charging station, viewed transversely of the can situated in the charging station, there are provided at least one emplacement for a full can and at least one can emplacement for an empty can. Preferably, the first standby station is associated with a conveying device for the empty cans, for example, transport carriages, chains, belts or the like and the second standby station is associated with a device for removing the full cans, such as a conveyor belt, chains or the like.

According to a further feature of the invention, a can-engaging shifting element is provided which is situated above the can. Preferably, the shifting element is a can exchanger arm, for example, a rotatably supported bar or the like. Expediently, a separate can exchanger arm is provided for the empty can and for the full can dwelling in the charging station, and the arms may move the empty and full cans simultaneously.

By arranging the shifting element above the can, it is feasible to introduce the shifting element into the apparatus without needing significant space. A rotatably supported bar thus only needs to be rotated downwardly to engage the cans. In principle, one bar suffices which engages the empty can and pushes it into the charging station, whereby the full can is necessarily moved out of the charging station and into the can emplacement for the full cans, that is, into the second standby station. The use of two exchanger arms, that is, one exchanger arm for the empty can and one for the full can, however, results in a greater operational safety during can replacement, particularly as concerns a possible longitudinal can shifting. For these reasons this last mentioned embodiment is preferred.

In general, the displacement of the cans may be consecutively performed. According to a preferred embodiment of the invention, however, the exchanger arms simultaneously shift the empty and full cans in a single time period (cycle) without the need of a more complex control.

Since the loads derived from empty cans and full cans are different, according to an advantageous embodiment the empty can storage device and the full can storage device have their own drives. Expediently, the empty-can storage device and the full-can storage device are situated externally of the fiber processing machine (drafting frame or carding machine).

According to a further feature of the invention, first and second can standby tracks are provided, one end of which is, at their outer side, oriented towards the empty or full-can storage device and the other end of which is, at their inside, oriented towards the charging station. The standby tracks thus form a direct connection between the can storage devices.

On the endless transporting elements such as chains, belts or the like of the empty-can and full-can storage devices, guide elements (guide rails) for the cans are arranged perpendicularly to the transporting direction. The cans are loaded onto or unloaded from the storage device in a direction parallel to the guide rails. The guide rails thus have the purpose of ensuring a parallelism of the cans and may, at the same time, also have a certain carrier function.

If, according to another embodiment of the invention, the cans are loaded onto or unloaded from the storage device perpendicularly to the guide rails, the guide rails nevertheless ensure the parallelism of the loading, for example, onto or from the can standby belts.

In accordance with a particularly advantageous embodiment of the invention, the coiler head of the sliver coiler continues to rotate with a reduced speed during the can replacement. Such a speed reduction is not, however, to be construed as being limited exclusively to the coiler head; rather, the entire drafting frame or carding machine continues to run, that is, even during can replacement a drafting is performed by the drafting frame as opposed to conventional assemblies where the drafting frame or card had to be brought to a stop during the can replacing operation. Stated differently, this embodiment permits a further evening of the delivered sliver because a conventional stoppage and restart which cause changes in the drafting, may be eliminated.

According to another embodiment of the invention, a microcomputer is connected to the drives of the conveyor belts, the shifting mechanism, the coiler-can reciprocating mechanism, the drive of the drafting unit of the drafting frame, the empty-can storage device and the full-can storage device.

DESCRIPTION OF THE PREFERRED EMBODIMENTS

Figure 1:
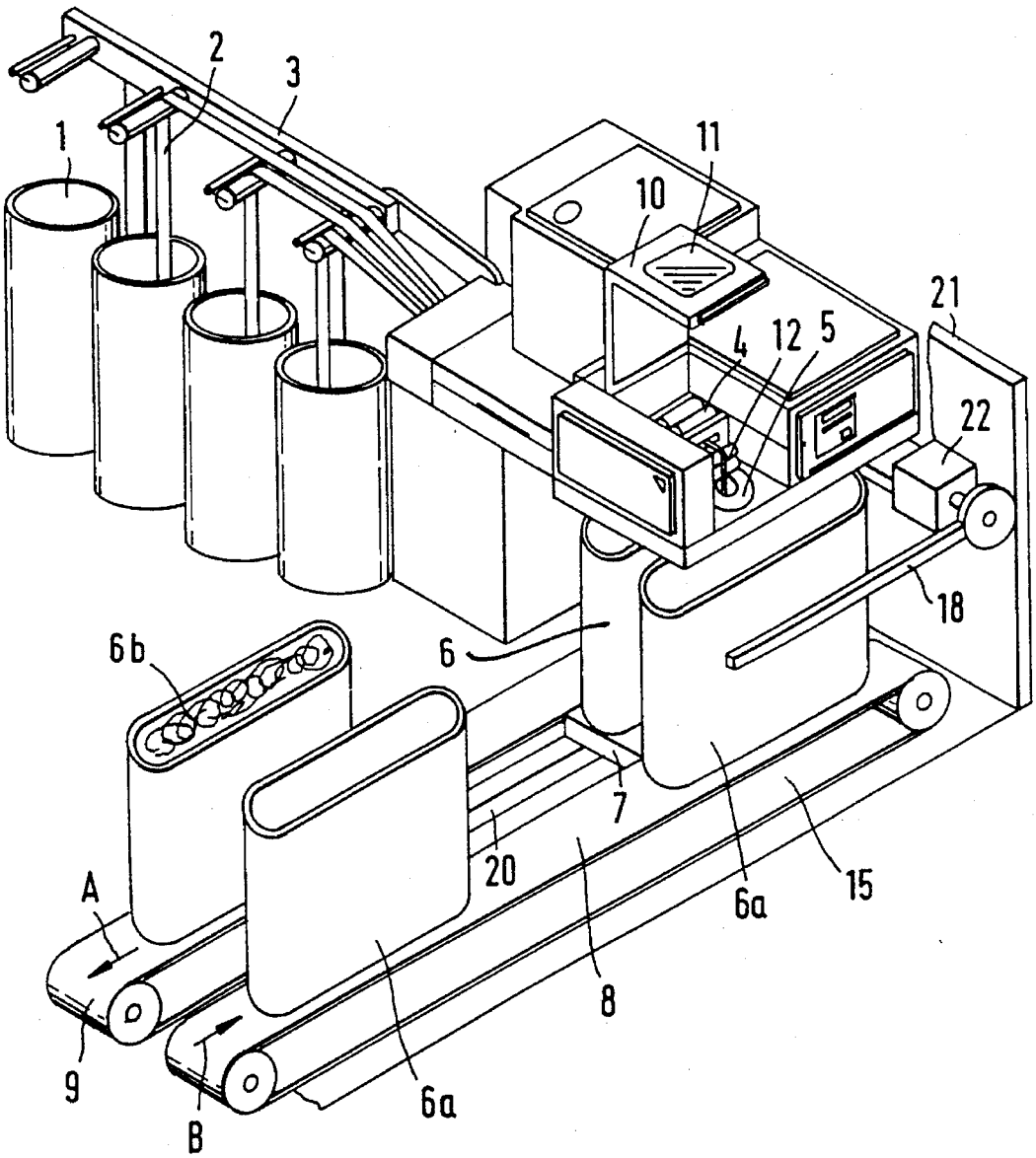
FIG. 1 is a schematic perspective view of a drafting frame incorporating the invention.

Turning to FIG. 1, there is illustrated therein a drafting frame in which cylindrical cans 1 are positioned underneath a sliver intake 3, and the sliver 2 is withdrawn from the cans 1 over rollers and fed to the drafting mechanism 4. The sliver 12, upon discharge from the drafting mechanism 4, is introduced into the rotary coiler head 5 and is deposited thereby in loops into the flat can 6 which is positioned in the sliver charging station on a sled 7 which may be moved back and forth on rails 20 by a displacing device. The drafting mechanism 4 and the rotary coiler head 5 are protected by a cover 10 in which a window 11 is provided for observing the coiling and drafting processes.

Underneath the rotary coiler head 5, immediately adjoining the sled 7, there extend two flanking can tracks constituted by two conveyor belts 8 and 9 which carry empty cans 6*a* and full cans 9*b*, respectively. Thus, the full cans 6*b* are carried away from the drafting frame on belt 9 in the direction of arrow A, whereas the empty cans 6*a* are moved towards the drafting frame on belt 8 in the direction of the arrow B. The flat cans 6, 6*a* and 6*b* are oriented such that their horizontal length dimension is parallel to the conveying directions A, B. The can 6 which is momentarily undergoing charging is positioned on the sled 7 directly underneath the rotary coiler head 5.

Figure 2A:
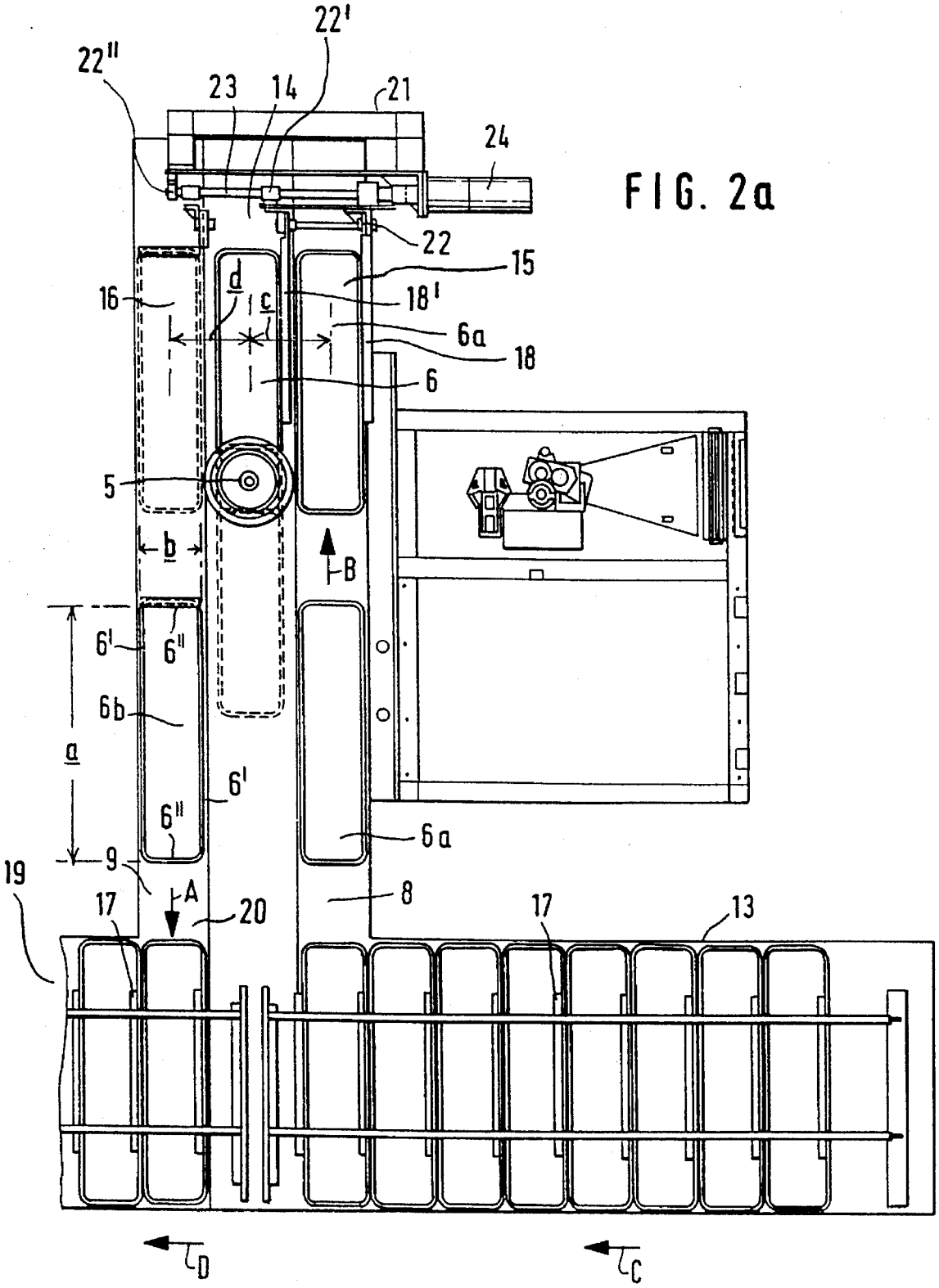
FIG. 2*a* is a top plan view of the construction shown in FIG. 1.

As shown in FIG. 2*a* an empty can 6*a* is situated in a first standby station 15, and a can 6 is situated in the charging station 14, that is, directly underneath the rotary coiler head 5. During the charging operation, the can 6 reciprocates between its solid-line rear position and its phantom-line forward position to thus effect deposition of coiled sliver by the rotary coiler head 5 uniformly along the coiler can length. The second standby station 16, that is, the standby station for a full can 6*b* (which is shown in phantom lines in FIG. 2*a*) is empty. A full can 6*b* is situated on the full-can belt 9 downstream of the second standby station 16 and moves in the direction A towards the full-can storage 19 as soon as the subsequent working cycle is started.

In the rearward zone of the charging station 14 a shifting mechanism 21 is positioned which is essentially composed of pivotally supported exchanger arms 18, 18', exchanger arm bearings 22, 22' and 22" as well as a shifting bar 23 having a longitudinal axis 23' and a shifting motor 24. The exchanger arms 18, 18' are at one end affixed to the shifting bar 23 in such a manner that in the position of rest they are situated above the cans 6, 6*a*. After rotation into a horizontal orientation, the exchanger arm 18 is situated in front of the empty can 6*a* and the exchanger arm 18' is located in front of the can 6 undergoing charging and thus is situated between the cans 6 and 6*a*. By moving the shifting bar 23 leftward as viewed in FIG. 2*a*, the full can 6 is pushed by the exchanger arm 18' into the second standby station 16 and, at the same time, the empty can 6*a* is shifted by the exchanger arm 18 from the first standby station 15 into the charging station 14 and thus assumes its position on the sled 7 underneath the rotary coiler head 5.

Figure 2B:
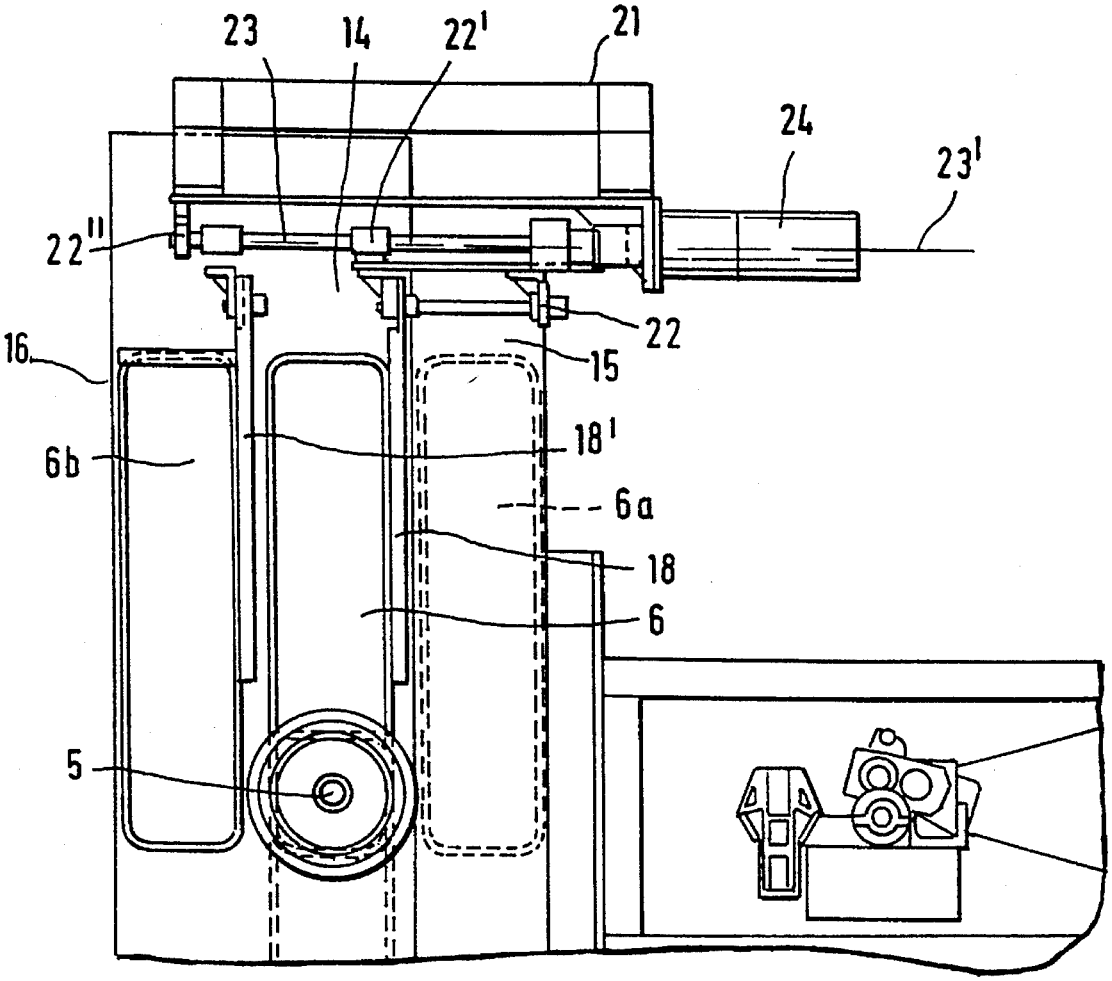
FIG. 2*b* is an enlarged top plan view of a detail of FIG. 2*a*.

As shown in FIG. 2*b*, as a result of such a shifting operation, the first standby station 15 for the empty cans 6*a* becomes free, the exchanger arm 18' lies, until it is pivoted upwardly, between the can 6 to be charged and the full can 6*b* and the exchanger arm 18 assumes its position on the other side of the can 6 to be charged.

While the can 6 is being charged, the empty-can belt 8 advances the empty can 6*a* already positioned thereon into the first standby station 15 for empty cans 6*a*. Simultaneously, a further empty can 6*a* arrives from the empty can storage 13 onto the empty-can belt 8 and is, in the direction of arrow B, advanced until the first empty can 6*a* has reached its terminal position in the first standby station 15. The first standby station 15 constitutes a terminal length portion of the empty-can belt 8, while the second standby station 16 constitutes an initial length portion of the full-can belt 9.

As the conveying step is performed by the empty-can belt 8 and the empty-can storage 13, the full-can storage 19 and the full-can belt 9 are started. As a result, in the full-can storage 19 in the region of the adjoining location 20 of the full-can belt 9 an emplacement becomes free, into which the full can 6*b* from the full-can belt 9 may be advanced.

In the can storage devices, that is, the full-can storage device 19 and the empty-can storage device 13, the cans 6*b* and, respectively, 6*a* are separated from one another by guide rails 17 which ensure a parallel alignment of the cans 6*a*, 6*b* corresponding to their longitudinal dimension as well as to the longitudinal dimension of the empty-can belt 8 and the full-can belt 9. The guide rails are oriented parallel to the advancing directions A, B of the belts 8 and 9.

Figure 3:
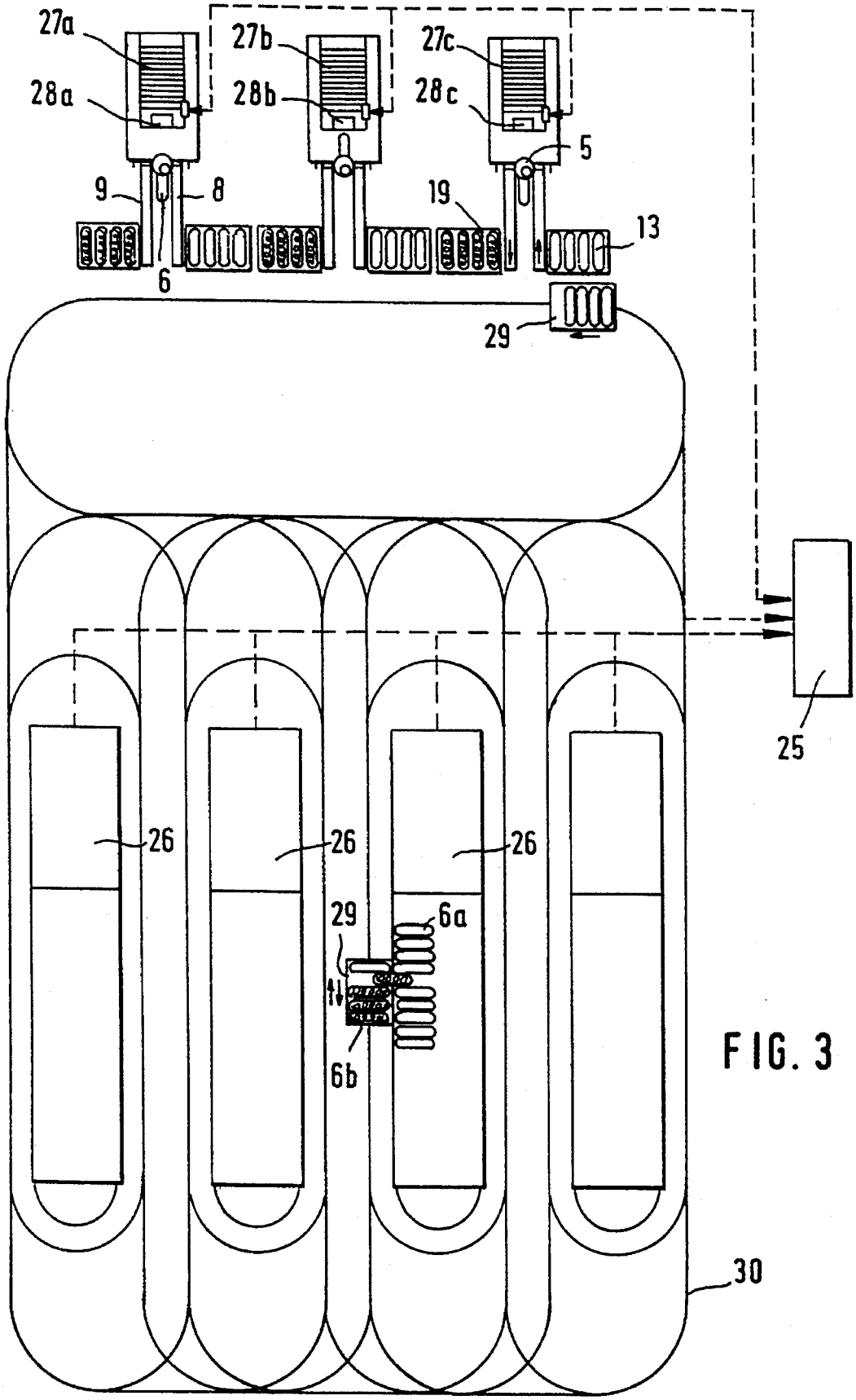
FIG. 3 is a schematic top plan view of a spinning plant including rotor spinning machines and sliver producing machines, containers for full and empty coiler cans and a centrally controlled can-carrying carriage.

Turning to FIG. 3, the method and apparatus according to the invention may find application in the direct spinning process. The method of performing automatic yarn making according to the invention, particularly in a spinning mill operating with rotor spinning machines, is based advantageously on the use of flat coiler cans, that is, coiler cans having an elongated horizontal cross section. Such a flat coiler can has—as shown, for example, for a full can 6*b* on the full-can belt 9 in FIG. 2*a* - two horizontally long opposite sides 6' and two horizontally short opposite sides 6", as well as a horizontal length dimension a measured parallel to the long sides 6' and a horizontal width dimension b measured perpendicularly to the horizontal length dimension a. The length of the travel path of the can from the first standby station 15 to the charging station 14 and from the charging station 14 to the second standby station 16 is very short and substantially corresponds to the width dimension b of the can. Thus, such length of travel, that is, the center-to-center distance c between the first standby station 15 and the charging station 14, as well as the center-to-center distance d between the charging station 14 and the second standby station 16 each substantially corresponds to the can width b. Flat cans may be positioned on selected working locations accurately and in an oriented manner with easily realizable means. A flat coiler can has the further advantage that because of the more efficient coverage of floor surfaces by the cans and the more uniform deposition therein of the sliver, approximately twice the amount of sliver may be positioned underneath the spinning station of a rotary spinning machine than possible with cylindrical cans (that is, cans of circular cross-sectional area).

The automated process of yarn making is controlled by a central control apparatus 25 which makes decisions concerning the exchange of cans 6*a*, 6*b* underneath the spinning stations of the rotary spinning machines 26, for example, based on the sum of two logic signals such as reaching or exceeding a predetermined spinning period of one spinning station so that at that spinning station the spinning process was interrupted. To optimize the process of exchanging the cans 6, the control apparatus 25 utilizes data concerning the spinning period of the individual spinning stations since the last exchange of a can 6 at the respective spinning station. As charging stations 4 for the cans 6 there are used aggregates such as carding machines 27*a*, 27*b* and 27*c* and drafting frames 28*a*, 28*b* and 28*c* each having a rotary coiler head 5. With each carding machine 27*a*, 27*b* and 27*c* there is associated an empty-can storage device 13 and a full-can storage device 19 for the cans 6. There are further provided automated mechanical means for the transverse removal of the cans from the empty-can storage device (container) 13, their consecutive positioning and handling underneath the rotary coiler head 5 of the respective drafting frame 28*a*, 28*b*, 28*c* and the subsequent deposition in the full-can storage device (container) 19.

On the lateral containers (storage devices) of a conventional belt or roller-type conveyor the cans are shifted in such a manner that they line up with their longitudinal walls facing one another after the consecutive charging with the sliver, until the entire number of full cans is reached. The sliver charging station is also provided with a suction device for removing residuals of sliver and dirt from the empty cans as well as a non-illustrated apparatus for the oriented attachment of the sliver end to a selected position close to the upper edge of each full can.

Between the rotor spinning machines 26 on the one hand and at least one sliver charging station of a rotor spinning machine 26, on the other hand, in the floor of the spinning room an induction strip 30 is installed by means of which the signals from the central control apparatus 25 and the signals of the sensors to and from the automatically controlled transport carriages 29 are transmitted in a contactless manner.

It will be understood that the above description of the present invention is susceptible to various modifications, changes and adaptations, and the same are intended to be comprehended within the meaning and range of equivalents of the appended claims.

What is claimed is:

1. A method of handling flat coiler cans charged and to be charged with sliver in a sliver charging station of a sliver producing fiber processing machine; each can having, as viewed in an upright position thereof, two opposite, first vertical walls and two opposite, second vertical walls; said first walls being horizontally longer than said second walls; each said can having a horizontal length dimension measured parallel to said first walls and a horizontal width dimension measured perpendicularly to the length dimension; said length dimension being greater than said width dimension; comprising the following steps:

(a) advancing an empty can into a first standby station situated at said sliver charging station;

(b) advancing an empty can from said first standby station into said sliver charging station in a direction parallel to said width dimension;

(c) charging a can with sliver in said sliver charging station;

(d) advancing a full can, in a direction parallel to said width dimension, from said sliver charging station into a second standby station situated at said sliver charging station; and (e) advancing a full can out of said second standby station.

2. The method as defined in claim 1, wherein steps (b) and (d) are performed simultaneously.

3. The method as defined in claim 1, further comprising the step of introducing the full can into a storage device subsequent to step (e).

4. The method as defined in claim 1, wherein steps (a) and (e) are performed simultaneously.

5. The method as defined in claim 1, wherein steps (a) and (e) are performed while performing step (c).

6. The method as defined in claim 1, wherein steps (a) and (e) comprise the step of advancing the cans in a direction parallel to said horizontal length dimension of the cans.

7. The method as defined in claim 1, further wherein step (c) comprises the step of imparting, in a direction parallel to said length dimension, a back-and-forth motion of the can undergoing charging in said sliver charging station.

8. The method as defined in claim 1, wherein advancing steps (b) and (d) each includes a travel path substantially corresponding to said width dimension.

9. A combination of a sliver-producing fiber processing machine and an apparatus for handling sliver outputted by the machine; the combination comprising:

(a) a plurality of flat coiler cans charged and to be charged with sliver by the sliver-producing fiber processing machine; each can having, as viewed in an upright position thereof, two opposite, first vertical walls and two opposite, second vertical walls; said first walls being horizontally longer than said second walls.; each said can having a horizontal length dimension measured parallel to said first walls and a horizontal width dimension measured perpendicularly to the length dimension; said length dimension being greater than said width dimension;.

(b) a sliver charging station forming part of said sliver-producing fiber processing machine;

(c) a first standby station situated adjacent said sliver charging station for receiving an empty can therein;

(d) a second standby station situated adjacent said sliver charging station for receiving a full can from said sliver charging station; and (e) can shifting means for displacing an empty can from said first standby station into said sliver charging station and for displacing a full can from said sliver charging station, in a direction parallel to said width dimension, into said second standby station.

10. The combination as defined in claim 9, wherein said first and second standby stations are elongated and are disposed parallel to one another and flank said sliver charging station.

11. The combination as defined in claim 10, wherein said first and second can tracks include respective first and second conveyors.

12. The combination as defined in claim 11, wherein said conveyors are endless conveyor belts.

13. The combination as defined in claim 9, further comprising a first can track having a length portion constituting said first standby station; said first can track receiving empty cans and supplying the empty cans to said first standby station in a direction parallel to said length dimension; and a second can track having a length portion constituting said second standby station; said second can track receiving full cans from said second standby station in a direction parallel to said length dimension.

14. The combination as defined in claim 13, wherein said first can track has an input remote from said first standby station and said second can track has an output remote from said second standby station; further comprising an empty-can storage device adjoining said input of said first can track for transferring empty cans to said first can track; and a full-can storage device adjoining said output of said second can track for receiving full cans from said second can track.

15. The combination as defined in claim 14, further comprising separate drives for said empty-can and full-can storage devices.

16. The combination as defined in claim 14, wherein said empty-can storage device and said full-can storage device each include an endless conveyor having a length dimension; each said endless conveyor comprising spaced can guiding elements oriented parallel to directions of advance of the cans on said first and second can tracks.

17. The combination as defined in claim 13, wherein said sliver charging station comprises reciprocating means for moving a can in said sliver charging station back and forth during a sliver charging operation in a direction parallel to said length dimension; further wherein said first and second can tracks each include a conveyor belt and drive means therefor; said sliver-producing fiber processing machine is a drafting frame including a drafting mechanism and a drive therefor; further comprising an empty-can storage device adjoining said conveyor belt of said first can track for transferring empty cans thereto; and a full-can storage device adjoining said conveyor belt of said second can track for receiving full cans therefrom; further comprising a microcomputer connected to said drives of said conveyor belts, said shifting means, said reciprocating means, said drive of said drafting mechanism, said empty-can storage device and said full-can storage device.

18. The combination as defined in claim 9, wherein said can shifting means comprises (a) a shifting bar supported at a height level above and extending over said first and second standby stations and said sliver charging station; said shifting bar being rotatable about a longitudinal axis thereof and being longitudinally displaceable;

(b) an exchanger arm affixed to said shifting bar and extending generally perpendicularly therefrom; said exchanger arm having, dependent upon a rotary position of said shifting bar, an idling position in which said exchanger arm is oriented in an upward direction and a working position in which said exchanger arm is oriented generally horizontally for engaging a side wall of an empty can dwelling in said first standby station; and (c) power means for rotating and longitudinally displacing said shifting bar to move said exchanger arm into said working position and to shift said exchanger arm in said working position for pushing an empty can from said first standby station into said sliver charging station.

19. The combination as defined in claim 9, wherein said can shifting means comprises (a) a shifting bar supported at a height level above and extending over said first and second standby stations and said sliver charging station; said shifting bar being rotatable .about a longitudinal axis thereof and being longitudinally displaceable;

(b) first and second exchanger arms affixed to said shifting bar and extending generally perpendicularly therefrom; each said first and said second exchanger arm having, dependent upon a rotary position of said shifting bar, an idling position in which the exchanger arms are oriented in an upward direction and a working position in which said exchanger arms are oriented generally horizontally; in said working position said first exchanger arm engaging a side wall of an empty can dwelling in said first standby station; and in said working position said second exchanger arm engaging a side wall of a full can dwelling in said sliver charging station; and (c) power means for rotating and longitudinally displacing said shifting bar to move the exchanger arms into said working position and to shift said exchanger arms in said working position for pushing an empty can from said first standby station into said sliver charging station and for simultaneously pushing a full can from said sliver charging station into said second standby station.

20. The combination as defined in claim 9, wherein a center-to-center distance between said first standby station and said charging station and between said charging station and said second standby station each substantially corresponds to said width dimension.

21. A spinning mill comprising (a) a plurality of carding machines;

(b) a separate sliver charging station forming part of each said carding machine;

(c) a plurality of flat coiler cans, each having, as viewed in an upright position thereof, two opposite, first vertical walls and two opposite, second vertical walls; said first walls being horizontally longer than said second walls; each said can having a horizontal length dimension measured parallel to said first walls and a horizontal width dimension measured perpendicularly to the length dimension; said length dimension being greater than said width dimension;

(d) a first standby station situated adjacent each said sliver charging station for receiving an empty can therein;

(e) a second standby station situated adjacent each said sliver charging station for receiving a full can from a respective said sliver charging station;

(f) can shifting means for displacing an empty can from said first standby station into said sliver charging station at each said carding machine and for displacing, in a direction parallel to said width dimension, a full can from said sliver charging station of each said carding machine into said second standby station;

(g) an empty-can storage device situated at each said carding machine for supplying empty cans to a respective said first standby station;

(h) a full-can storage device situated at each said carding machine for receiving full cans from a respective said second standby station;

(i) a spinning machine situated spaced from said carding machines; and (j) a transporting apparatus for conveying empty and full cans between said empty-can and full-can storage devices and said spinning machine.

22. A spinning mill as defined in claim 21, wherein a center-to-center distance between said first standby station and said charging station and between said charging station and said second standby station each substantially corresponds to said width dimension.

* * * * *